US007784227B2

(12) United States Patent
Ribeiro

(10) Patent No.: US 7,784,227 B2
(45) Date of Patent: Aug. 31, 2010

(54) MODULAR POOL CONSTRUCTIVE DESIGN

(75) Inventor: José Luiz Whitaker Ribeiro, Barueri (BR)

(73) Assignee: WBA Consultoria e Vendas Internacionais LTDA, Sao Paolo (BR)

( * ) Notice: Subject to any disclaimer, the term of this patent is extended or adjusted under 35 U.S.C. 154(b) by 802 days.

(21) Appl. No.: 10/549,422

(22) PCT Filed: Mar. 17, 2004

(86) PCT No.: PCT/BR2004/000033

§ 371 (c)(1),
(2), (4) Date: Sep. 15, 2005

(87) PCT Pub. No.: WO2005/064100

PCT Pub. Date: Jul. 14, 2005

(65) Prior Publication Data

US 2006/0179561 A1 Aug. 17, 2006

(30) Foreign Application Priority Data

Mar. 17, 2003 (BR) ..... PI0300763-4

(51) Int. Cl.
*E02D 27/00* (2006.01)
*E02D 27/42* (2006.01)
*E04B 1/00* (2006.01)
*E04H 4/00* (2006.01)

(52) U.S. Cl. ..... 52/169.7; 52/299; 52/270; 4/506

(58) Field of Classification Search ..... 52/169.7, 52/762, 780, 102, 299, 261, 263, 270, 278, 52/648.1, 650.1, 650.3, 653.1; 4/488, 506
See application file for complete search history.

(56) References Cited

U.S. PATENT DOCUMENTS

| | | | | | |
|---|---|---|---|---|---|
| 2,490,272 | A | * | 12/1949 | Kascle | 52/169.7 |
| 2,830,332 | A | * | 4/1958 | Pawlowski | 52/126.6 |
| 2,836,832 | A | * | 6/1958 | De Namur | 52/169.7 |
| 3,026,538 | A | * | 3/1962 | Boyd et al. | 4/487 |
| 3,080,022 | A | * | 3/1963 | Mote | 52/405.4 |
| 3,427,662 | A | * | 2/1969 | Baroody et al. | 52/169.7 |
| 3,551,920 | A | * | 1/1971 | Greene | 52/149 |
| 3,553,744 | A | * | 1/1971 | Gillen | 52/169.7 |
| 3,629,985 | A | * | 12/1971 | Ueno | 52/265 |
| 3,638,245 | A | * | 2/1972 | Birkemeier | 52/169.7 |
| 3,798,857 | A | * | 3/1974 | Barrera | 52/169.8 |
| 3,820,174 | A | * | 6/1974 | Rozanski | 52/169.7 |
| 3,835,605 | A | * | 9/1974 | Ueno | 52/169.7 |

(Continued)

FOREIGN PATENT DOCUMENTS

DE 1264031 B 3/1968

*Primary Examiner*—Richard E Chilcot, Jr.
*Assistant Examiner*—Ryan D Kwiecinski
(74) *Attorney, Agent, or Firm*—Gerry J. Elman; Elman Technology Law, P.C.

(57) ABSTRACT

Modular pool constructive design whose walls are constituted by metallic panels (17, 18, 19), made up by folding metallic sheets, comprising a bottom including a structure that supports a plurality of metallic panels-tiles (16) —said walls (11, 12, 13, 14) are connected to said bottom's structure, making up a unique and non-deformable structure, all the pool's elements are interlinked by semi-permanent connecting means, such as screws and nuts. The dimensions of the pool's elements allow its easy transport in small vehicles or buildings' elevators.

5 Claims, 11 Drawing Sheets

U.S. PATENT DOCUMENTS 3,839,751 A * 10/1974 Bressler ..... 4/509
3,971,075 A * 7/1976 Heinbaugh et al. ..... 52/169.7
4,047,340 A * 9/1977 Witte et al. ..... 52/169.7
4,118,809 A * 10/1978 Bertsch ..... 52/149
4,124,907 A * 11/1978 Laven ..... 52/169.7
4,177,614 A * 12/1979 Arp ..... 52/247
4,473,978 A * 10/1984 Wood ..... 52/169.8
4,501,100 A * 2/1985 Corna et al. ..... 52/169.7
4,635,304 A * 1/1987 Zikmanis et al. ..... 4/506
5,010,603 A * 4/1991 Hertzog ..... 4/506
5,239,798 A * 8/1993 Saito ..... 52/235
5,277,004 A * 1/1994 Frei ..... 52/169.7
5,400,555 A * 3/1995 Kantor ..... 52/169.7
5,488,745 A * 2/1996 Barrera ..... 4/506
5,575,124 A * 11/1996 Novello, Jr. ..... 52/270
5,791,098 A * 8/1998 Thomas ..... 52/169.6
5,884,347 A * 3/1999 Yurchision et al. ..... 4/506
6,367,099 B1 4/2002 Contrino et al.
6,378,144 B1 * 4/2002 Yurchision ..... 4/506
6,421,846 B1 * 7/2002 Shaanan et al. ..... 4/506
6,571,404 B2 * 6/2003 Hall ..... 4/506
6,647,562 B1 * 11/2003 Arout et al. ..... 4/506
6,795,985 B2 * 9/2004 Mathias ..... 4/506
7,024,831 B1 * 4/2006 Clark et al. ..... 52/223.7
7,240,459 B2 * 7/2007 Daudet et al. ..... 52/289
7,373,760 B2 * 5/2008 Tokuno et al. ..... 52/223.7
2002/0020011 A1 * 2/2002 Arout et al. ..... 4/506
2002/0100230 A1 * 8/2002 Mazure ..... 52/169.7
2006/0179561 A1 * 8/2006 Ribeiro ..... 4/506

* cited by examiner

MODULAR POOL CONSTRUCTIVE DESIGN

FIELD OF THE INVENTION

The present invention refers to the construction of pools and, more specifically, to pools made up of metallic modules of standardized dimensions.

BACKGROUND OF THE STATE OF THE ART

The growing popularity of pools for recreational, therapeutic and domestic use has resulted in the creation of a plurality of types and models, intended to meet the market's large variety of expectations. Among others, the most widely known are the following:

- concrete pools, lined with tiles, miniature tiles or vinyl linings;
- fiberglass pools, manufactured according to standard dimensions and shapes;
- mixed-type pools, with a concrete base (bottom) and walls made of blocks, clay bricks or metallic sheets, usually waterproofed with vinyl lining or fiberglass skin.

However, constructing pools of the above mentioned types is a relatively complex, slow and expensive process, since, in addition to requiring specialized labor, they have disadvantages inherent to their nature.

In fact, it is known that concrete structures require the manufacture of molds that, once used, are disposed of, resulting in a substantial waste of material.

Fiberglass pools, although not having this shortcoming, require digging a hole in the ground with the proper dimensions, as well as the provision of a concrete support bottom.

Additionally, neither concrete nor fiberglass pools can be moved to another location, nor can they have their dimensions altered, leaving no choice for their owners but to live with the original dimensions forever. For instance, in a pool built for small children, it becomes impossible to increase its depth when these children grow up.

Conventional pools have other shortcomings, such as the need for special techniques to install underwater lighting (which must be planned before the construction begins), as well as the impossibility of altering the number or positions of these lighting fixtures after the construction is finished.

The above-mentioned inconveniences have led to the search for solutions based on modular techniques, in order to result in more accessible costs, as well as to reduce assembly time and to facilitate said assembly work. This trend is exemplified by patent documents U.S. Pat. No. 3,798,857 to Barrera (hereinafter "Barrera"), U.S. Pat. No. 3,820,174 to Rozanski (hereinafter "Rozanski"), U.S. Pat. No. 4,047,340 to Witte et al (hereinafter Witte) and DE 1264031 to Dr. Theodor Kootz (hereinafter "Kootz").

The inventions described in the above-mentioned documents, however, have shortcomings that limit their usefulness, as discussed below. Barrera discloses a pool whose walls consist of modules made of steel sheets, equipped with coupling means between the vertical edges of adjacent modules, whose assembly results in the pool's side walls, as shown in FIG. 1. Said coupling means comprise rectangular slots into which tabs are inserted, the retention between modules being provided by locking pins. The shapes of these tabs require expensive manufacturing processes. Moreover, as shown in FIG. 1, the pool has to be placed inside a hole dug into the ground.

In addition, the modules of Barrera do not apply to the bottom of the pool, which is made of concrete and requires specialized as well as costly labor, which is also needed to manufacture the concrete blocks that provide support to the walls' anchor beams.

Rozanksi discloses a pool whose walls are made of steel sheet modules, complemented by a three-dimensional lattice structure as shown in FIGS. 2 and 3. The object of this is to provide a supporting structure for the ladder's handrails, as well as supporting a concrete deck or pavement surrounding the edge of the pool. As in the previous example, the bottom of the pool requires specialized labor, which is also necessary to lay the concrete pavement. These operations are time consuming, due to the time needed for the concrete to harden.

Witte discloses a pool with walls made up of modular plate-shaped elements that have, in their vertical edges, grove and tongue joints. The horizontal forces are supported by X-shaped prefabricated elements, as shown in FIGS. 4 and 5. As shown in FIG. 5, a concrete bottom 90 must be provided to support the wall modules 32 as well as the internal edge of the deck 20 that surrounds the pool. The external edges of said deck rests upon one of the arms 50 of the X-shaped elements, whose bottom arm 50*d* rests on a metallic footing 80 that is secured to the ground or according Witte—a concrete base, not shown in the drawing. Said base is necessary due to the fact that the thrust resulting from the water's pressure upon the walls is also unloaded on this footing. In the subject matter of this patent, the same considerations regarding the delay in the construction time are also applicable.

Kootz teaches a swimming pool having its bottom, as well as its sides, formed of metallic tray-like modules that are bolted together. The pool has two parts with different depths: in the shallower part, the walls are composed of a single row of panels, whereas in the deeper portion, the walls are higher, being formed of two superposed rows of panels. In the bottom of the pool, the tray-like panels are placed with their flanges facing up (i.e., the inside of the pool). This configuration is necessary due to the fact that said panels must be bolted together to form the bottom. However, to attain a uniform bottom surface, the trays must be filled with concrete covered with a fiberglass layer. Therefore, the pool cannot be disassembled, as the bolts which join said bottom panels are be encased in concrete. Moreover, said bottom panels have to be laid on a leveled surface, preferably, one that has been compacted or overlaid with a layer of concrete. Additionally, the horizontal thrust upon the side panels, due to the water pressure, may result in the outward bending of the walls of said deeper portion, mainly along the joints between the upper and lower rows of panels. This sets a limit to the number of panels that can be superposed to increase the height of said side walls and, therefore, the pool's depth.

The above-mentioned examples of the state of the art suffer from serious shortcomings due to the possibility of structural damages due non-uniform resistance from the ground on which the pool lies. Such is particularly the case with the objects of Barrera and Witte.

OBJECTS OF THE INVENTION

In view of the above, a first object of the invention is to provide a modular pool that is not affected by irregularities of the soil's compression resistance.

Another object is to provide a modular pool adapted to be easily and quickly assembled, without recourse to specialized labor.

Another object is to provide a modular pool adapted to be easily assembled and disassembled.

Yet another object is to provide a modular pool whose construction does not require the use of concrete walls or bottom, blocks or bricks.

Yet another object is to provide a modular pool that allows the inclusion of a deck.

Another additional object is to provide a modular pool that can be easily changed in dimensions and shape.

Another object is to provide a modular pool adapted to be assembled either below or above ground level.

SUMMARY OF THE INVENTION

The above-mentioned objects, as well as others, are attained by the present invention through a modular pool in which the bottom edges of the metallic modules that form the walls are attached by semi-permanent attaching means to a latticed base structure composed of a plurality of metallic sleepers placed crosswise at right angles to a plurality of parallel metallic beams running lengthwise, said metallic sleepers and said beams being "U" section shaped with the central portion being vertically oriented.

In accordance with an additional feature of the invention, the metallic modules that form the walls are made from sheet metal comprising a rectangular shaped center portion provided with flanges along the vertical and horizontal edges of said central portion.

According to another feature of the invention, said flanges are bent at a right angle relation to said central portion.

In accordance with an additional feature of the invention, said semi-permanent attaching means comprise angle irons having their vertical flange attached to the vertical central portion of said sleepers and beams, and their horizontal flange attached to the bottom flanges of the metallic modules that form the bottom tier of the pool's side walls.

According to another feature of the invention, the bottom of the pool comprises a plurality of modular bottom panels placed crosswise to the above-mentioned sleepers with their end portions being supported by the horizontal upper flange of said sleepers.

According to another feature of the invention, said modular bottom panels comprise modules provided with bottom draining openings.

According to yet another feature of the invention, said sleepers, beams and modular wall panels as well as said angle irons are joined by nuts and bolts.

BRIEF DESCRIPTION OF THE DRAWINGS

Additional advantages and features of the invention will be better understood through the description of a preferred embodiment and the accompanying drawings, in which.

DETAILED DESCRIPTION OF THE INVENTION

Figure 1:
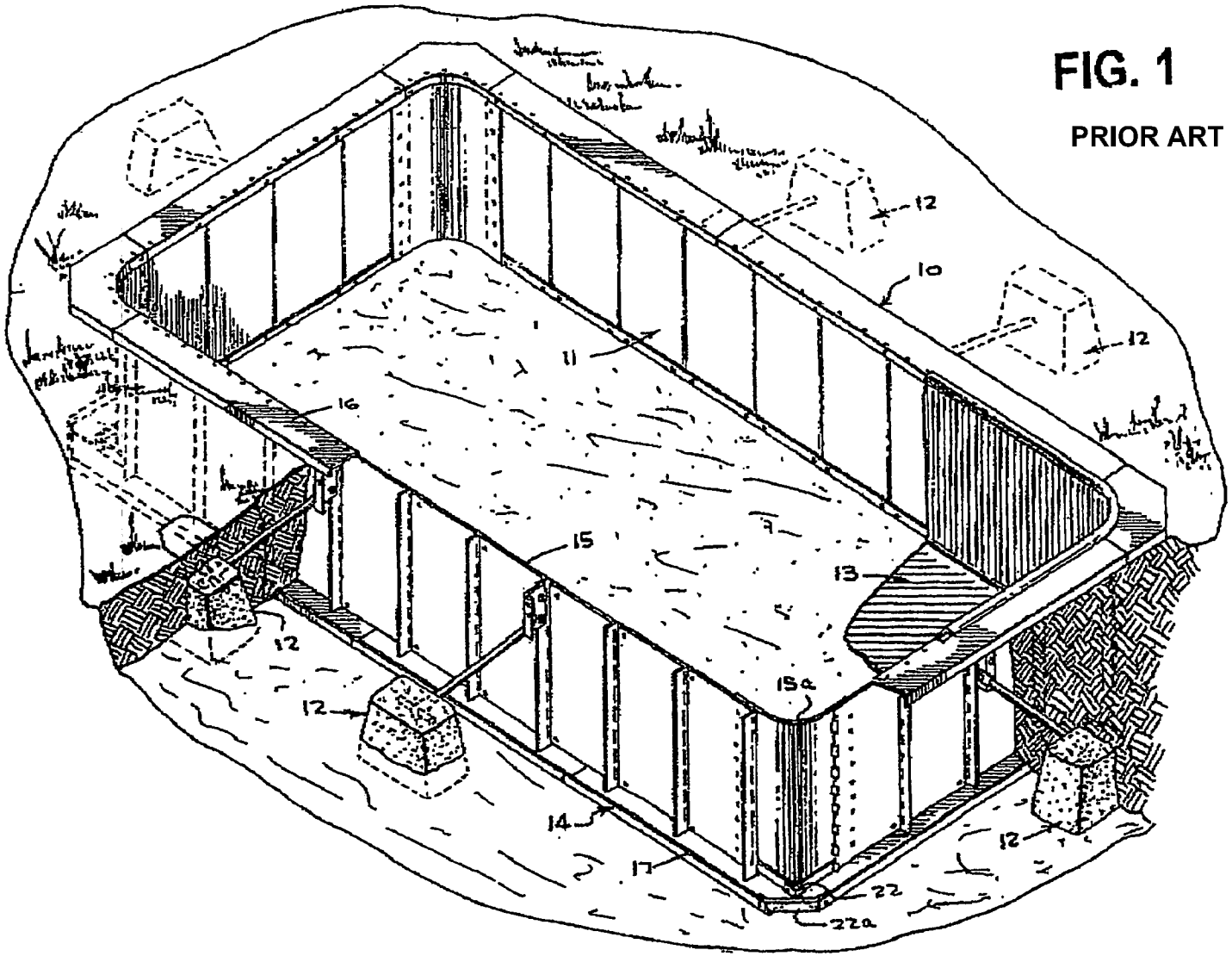
FIG. 1 PRIOR ART
FIGS. 1, 2, 3, 4 and 5 show pools built according to the previous art.
Figure 2:
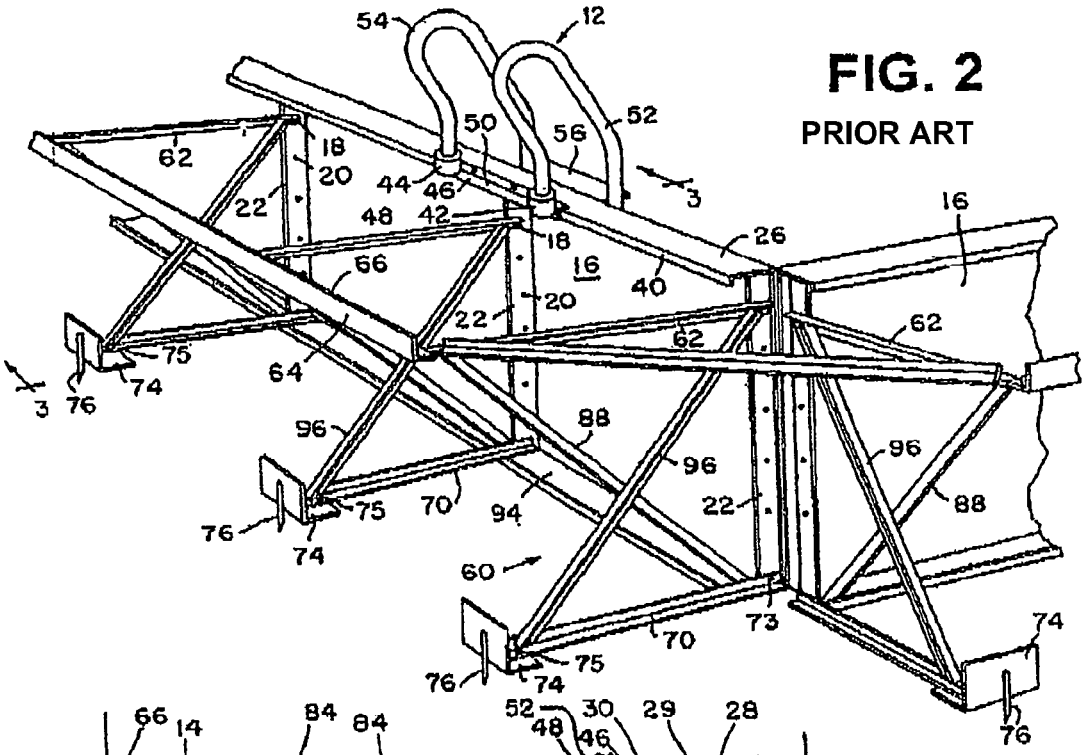
FIG. 2 PRIOR ART
Figure 3:
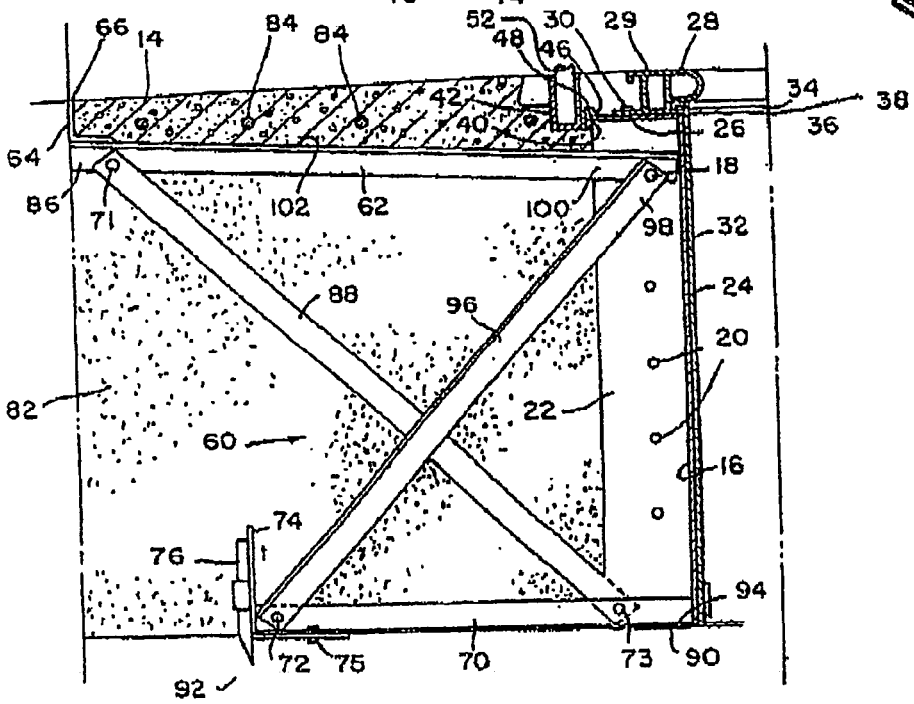
FIG. 3 PRIOR ART
Figure 4:
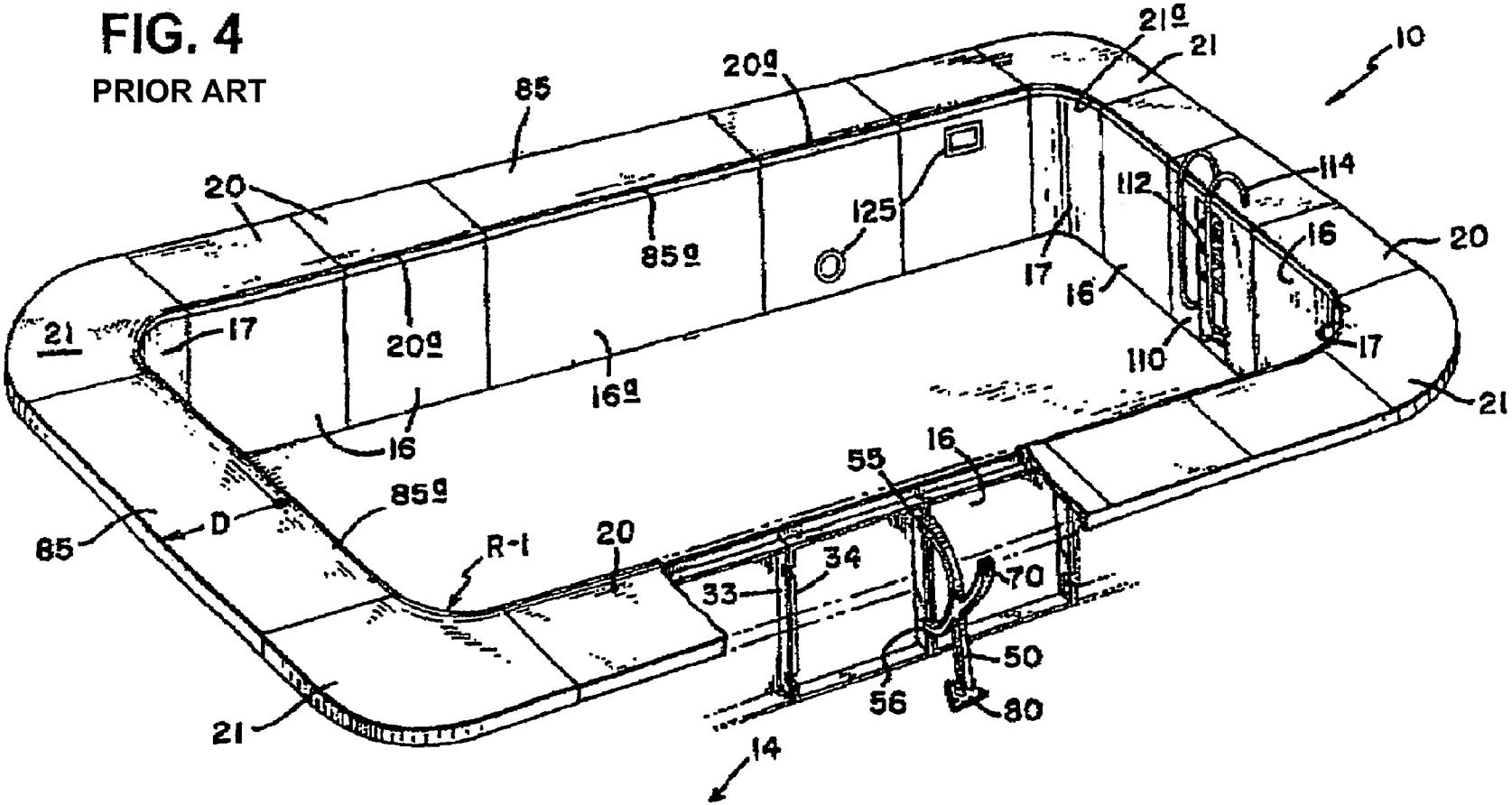
FIG. 4 PRIOR ART
Figure 5:
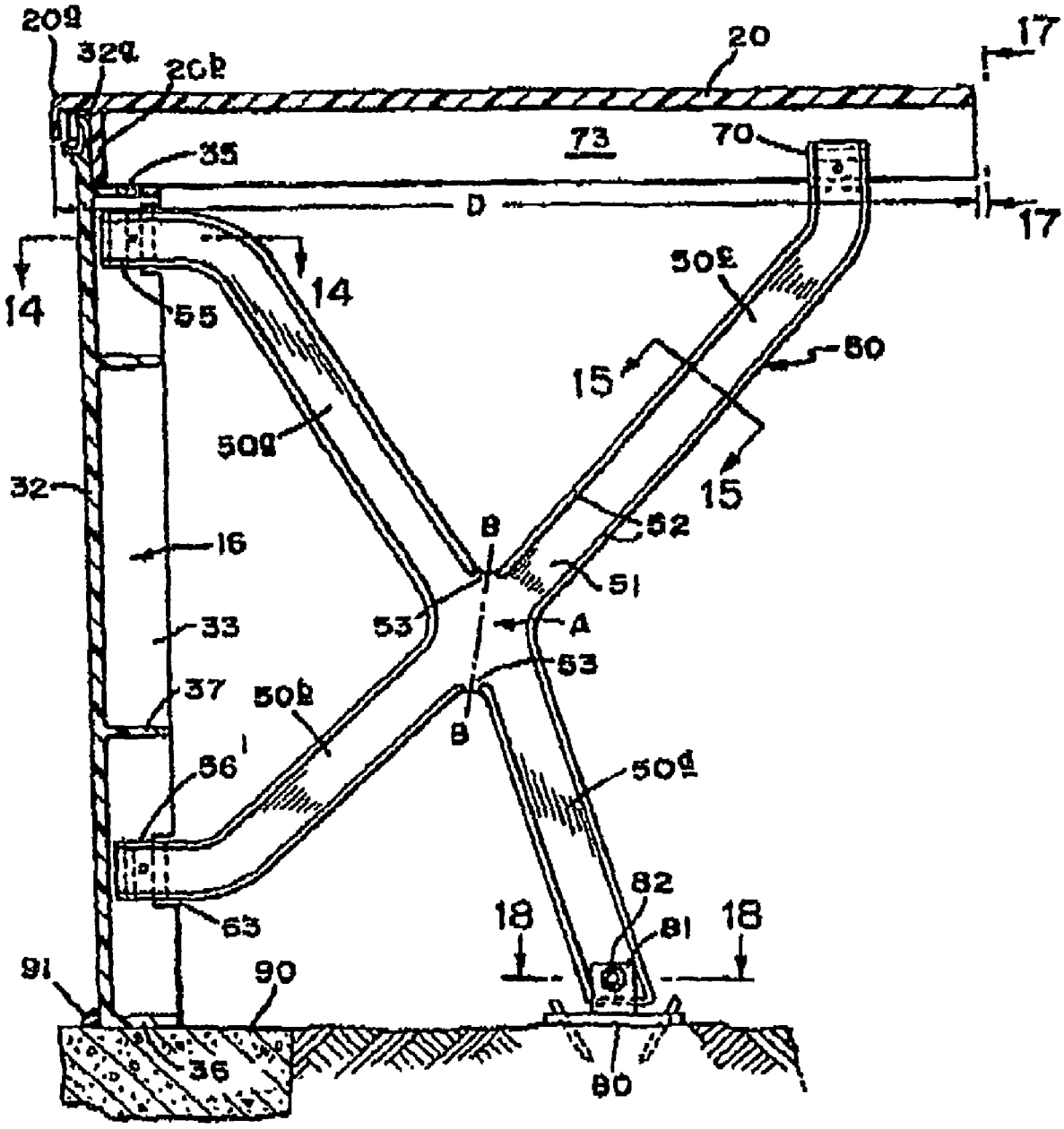
FIG. 5 PRIOR ART
Figure 6:
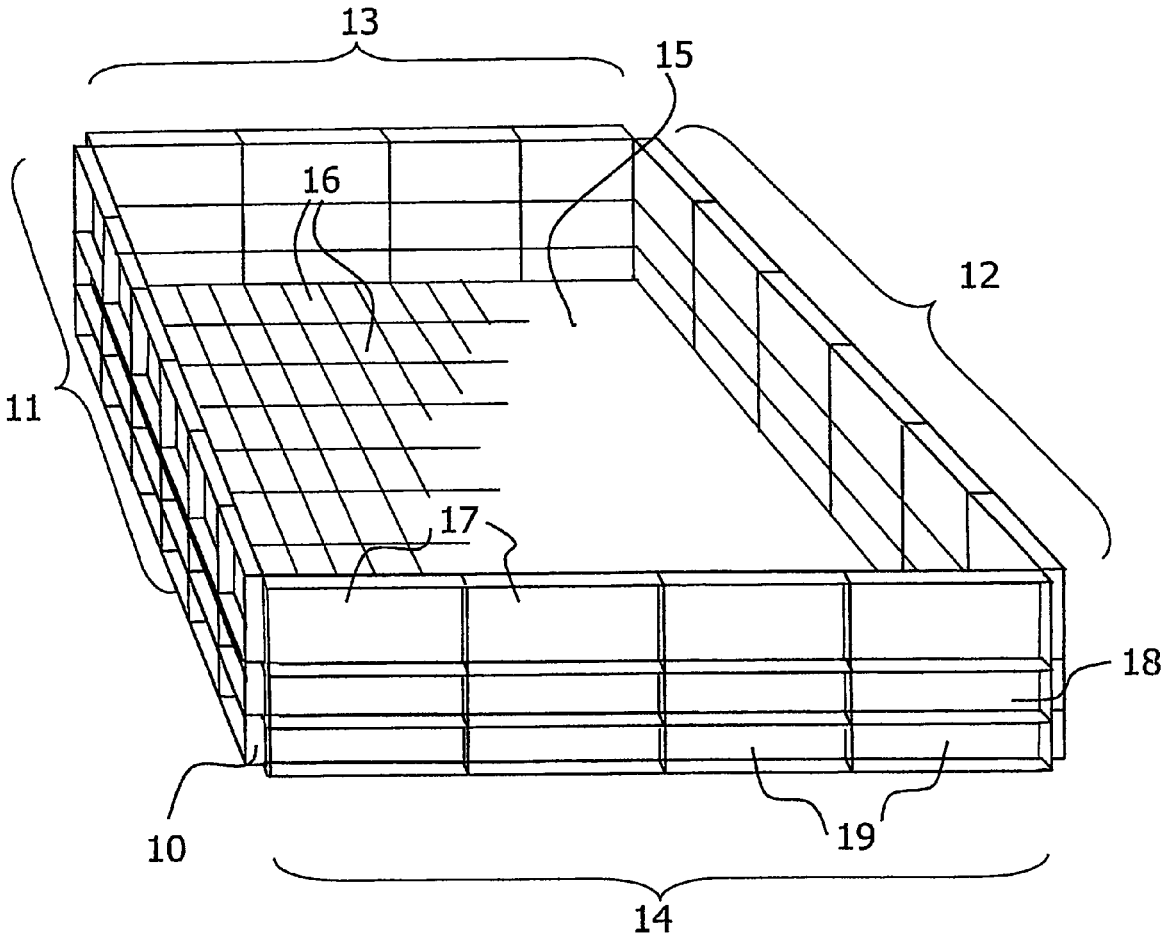
FIG. 6 is a general perspective view of the pool of the invention.

Referring now to FIG. 6 which shows a pool 10 built according to the invention, it can be seen that said pool comprises two side walls 11 and 12, two head walls 13 and as well as a bottom 15, all these parts consisting of constructive modular panels, as detailed below.

Considering that the exemplary embodiment shown in FIG. 6 has a standard depth of 1 meter, said side walls an said end walls are formed by three tiers of panels, all having the same standard length, such as, for example, one meter. Upper panels 17 have a useful height of 500 millimeters, intermediate panels 18 are 300 millimeters high and bottom panels 19 are 200 millimeters high. In order to leave a clearance of 130 millimeters between the water surface and the pool's upper edge, panels 17 are 630 millimeters high overall.

Still according to FIG. 6, the pool's bottom surface is made up by panels 16, hereinafter called "tiles", which completely line the bottom's surface and are supported by the latticed base (not shown in this drawing).

Additionally, all said pools component parts have dimensions that allow them to be loaded in pick-ups or small trucks for low cost transportation. So, in the exemplary embodiment herein described, the largest parts are the beams that comprise the lengthwise beams, which are only 2 meters long. This allows them to be transported in building's elevators, substantially reducing vertical transportation costs for pools assembled in penthouses.

Figure 7:
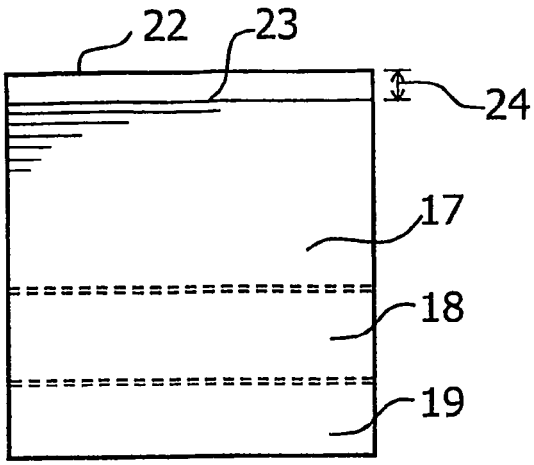
FIGS. 7, 8, 9 and 10 show side views of various combinations of modular side wall panels, providing different pool depths.
Figure 8:
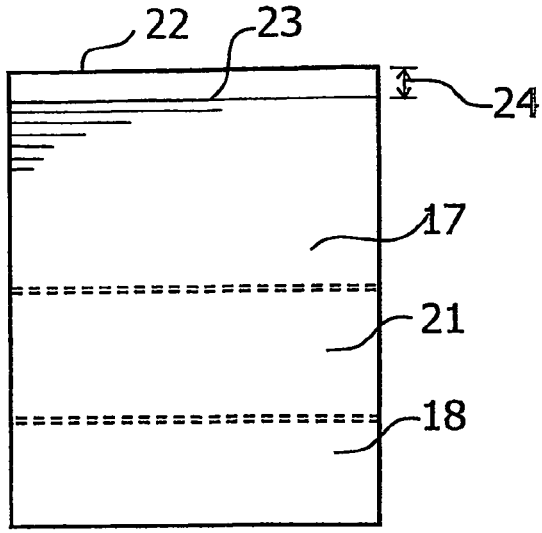
Figure 9:
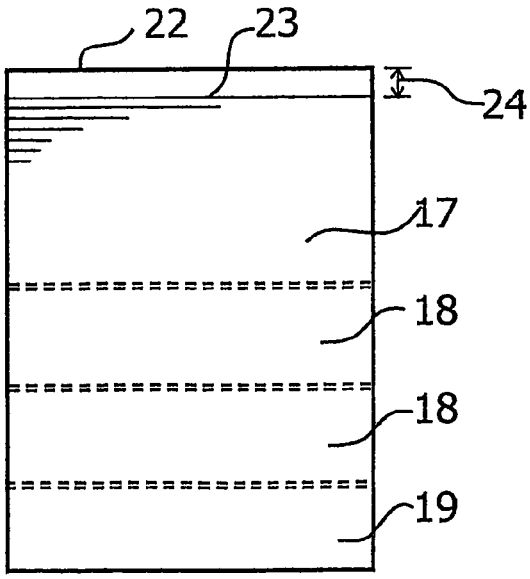
Figure 10:
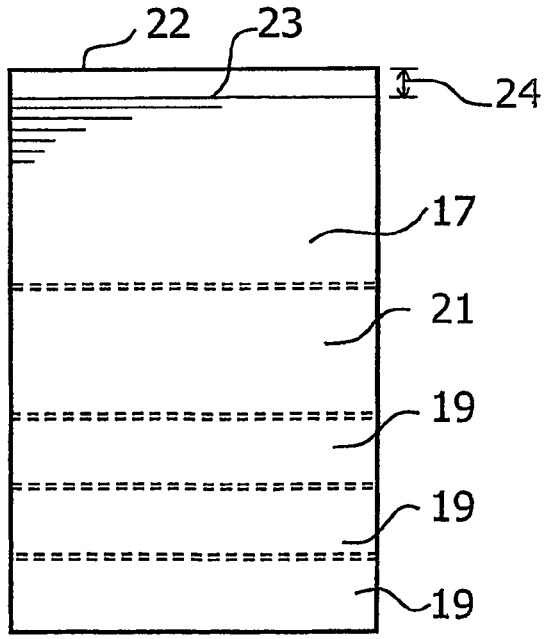

FIGS. 7 to 10 depict some exemplary arrangements of side panels of different heights, showing how the invention allows the construction of pools with various depths. FIG. 7 shows how a depth of 1 meter is attained by the superposition of panel 17, with a useful height of 500 mm, panel 18 with a height of 300 mm and panel 19 which is 200 mm high. In FIG. 8, a depth of 1.2 meters is attained by superposing a 500 mm panel 17, a 400 mm panel 21 and a 300 mm panel 18. A depth of 1.3 meters results from the superposition of one panel 17, two 300 mm panels 18 and at the bottom one 200 mm panel 19, as shown in FIG. 9. Finally, FIG. 10 exemplifies a 1.5 meter depth attained by overlaying one panel 17, one panel 21 and three panels 19, having heights of 500 mm, 400 mm and 200 mm, respectively.

As a general rule, the larger panels should be placed closer to the surface, progressively narrower panels being used at greater depths, so that the panels having smaller height (such as panels 19) are placed next to the floor. It is also noted that in the present exemplary embodiment panel 17 has a height greater than 500 mm, the excess 24 corresponding to the clearance between the water surface 23 and the top 22 of the pool's side walls.

Figure 11:
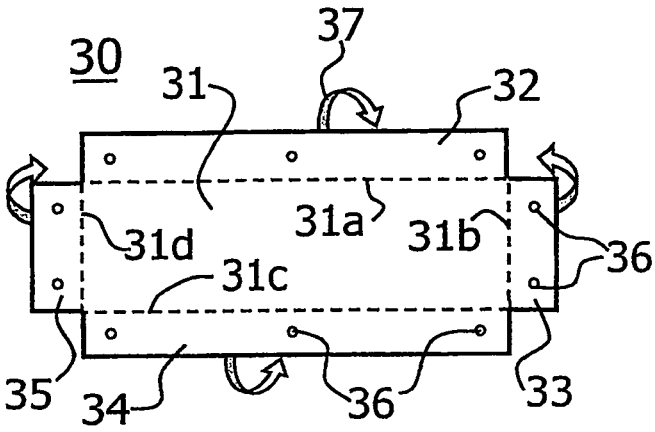
FIG. 11 shows a typical wall panel before folding of the flanges.

FIG. 11 shows how a panel 30 is formed from a rectangular metallic sheet. As shown, this sheet comprises a rectangular central portion 31 whose sides are contiguous with stripes 32, 33, 34, 35, the boundaries between said central portion and said stripes being the folding lines 31*a*, 31*b*, 31*c*, 31*d*. Said stripes have the same width and through-holes 36 placed at standardized positions, and are folded in the directions shown by arrows 37.

Figure 12:
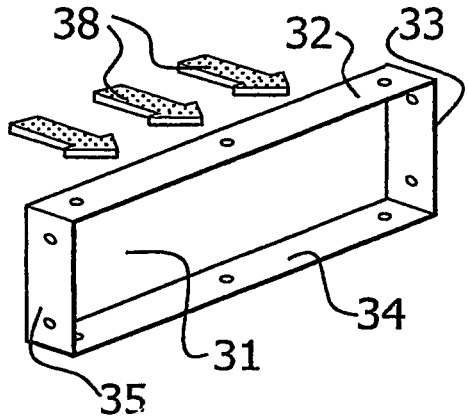
FIG. 12 shows the wall panel of the previous drawing, with the flanges folded and strengthening it in order to resist the water pressure.

FIG. 12 depicts the same panel after folding along said lines 31*a*, 31*b*, 31*c*, 31*d*, where it can be seen that the horizontal and vertical stripes act as flanges which absorb the bending stresses due to the water pressure 38 acting upon the central portion 31. Additionally, the through-holes in said stripes are used to connect adjacent panels to form the pool's side walls.

Figure 14:
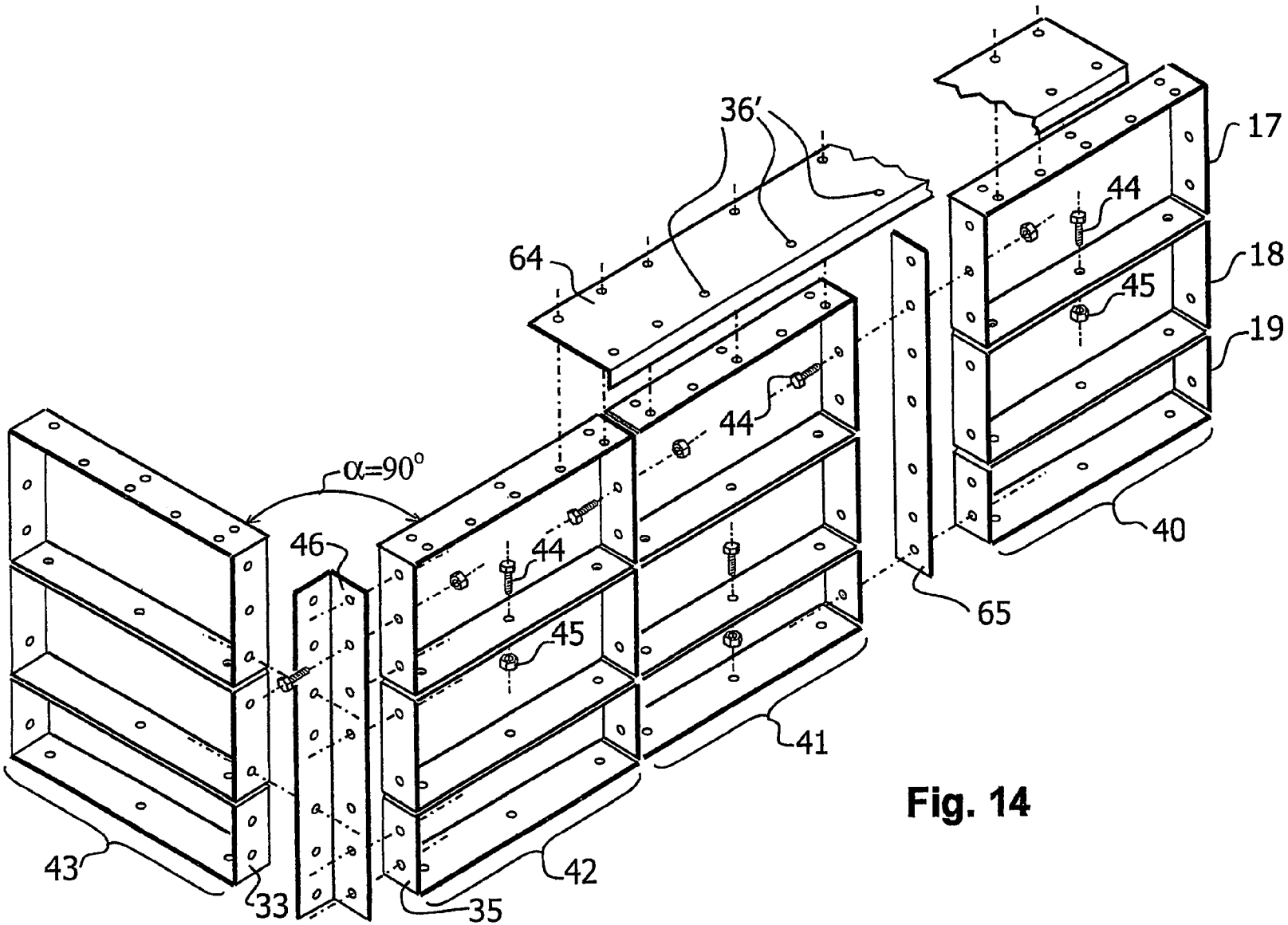
FIG. 14 shows an exploded view of the assembly of the side walls of a pool.

The general layout of the elements that form part of the wall as well as a rectangular corner are shown in FIG. 14. The first side wall comprises sets 40, 41 and 42, each one being formed by the superposition of modules 17, 18 and 19. As shown in this drawing, said vertically adjacent modules are joined by means of bolts 44 and nuts 45. The same nut-bolt elements are used to join the vertical flanges of said sets.

The drawing in FIG. 14 is exploded horizontally to show a vertical member 65 which is interposed and bolted between adjacent assemblies 40 and 41 (formed by panels 17, 18 and 19 vertically joined). This member 65 consists of a plate that may have the same width as the vertical flanges of said modular panels, and its height encompasses the total height of said assemblies. Said plate acts as a reinforcing member that resists the outward stresses acting upon the side walls, which tend to push outwardly central panels 18. Lengthwise reinforcement at the top of the pool's wall is provided by a metal plate 64 whose through-holes 36' are coincident with the through-holes of the upper flanges of the upper panels. Said metal plate 64 may be used to support a deck floor along the walls.

FIG. 14 also depicts a right-angle joint between two side walls of the pool. As shown, the vertical flanges of the identical modules at the free ends of assemblies 42 and 43 are bolted to the flanges of an angle iron 46, which is provided with through-holes in positions coincident with the holes of said flanges.

Figure 13:
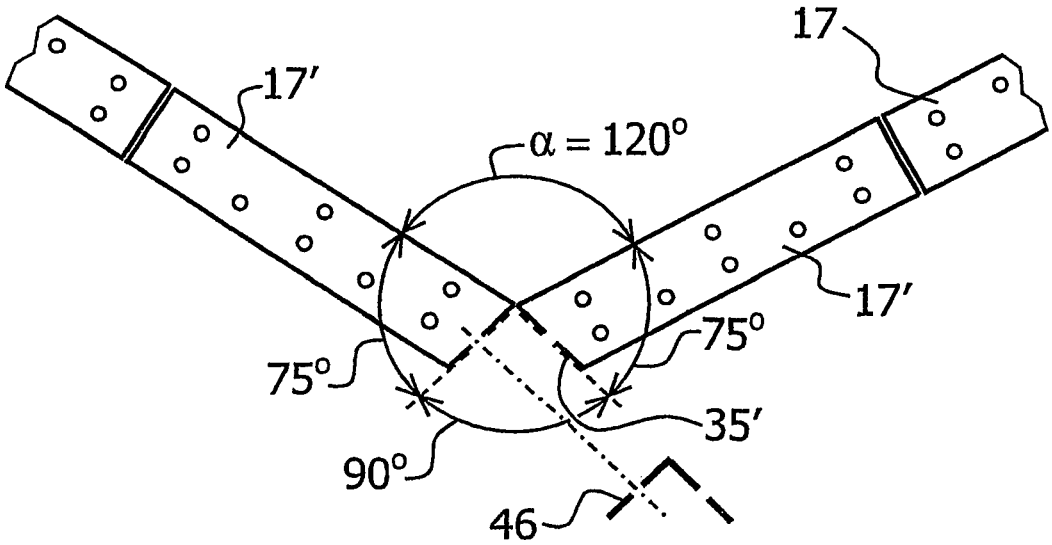
FIG. 13 shows, by means of a top view, a corner where the side walls meet at an angle different from 90°.

It should be stressed that the pool's layout is not limited to right angles $\alpha=90°$ as shown in FIG. 14. For instance, an angle of $\alpha=120°$ for hexagonal shaped pools is shown in FIG. 13. In this case, side flanges 35' adjacent to said angle iron 46 are folded at angles of 75° in relation to the central part of panels 17'. The corresponding upper and lower flanges of the panels 17' have also been cut in accordance with this angle.

Figure 15:
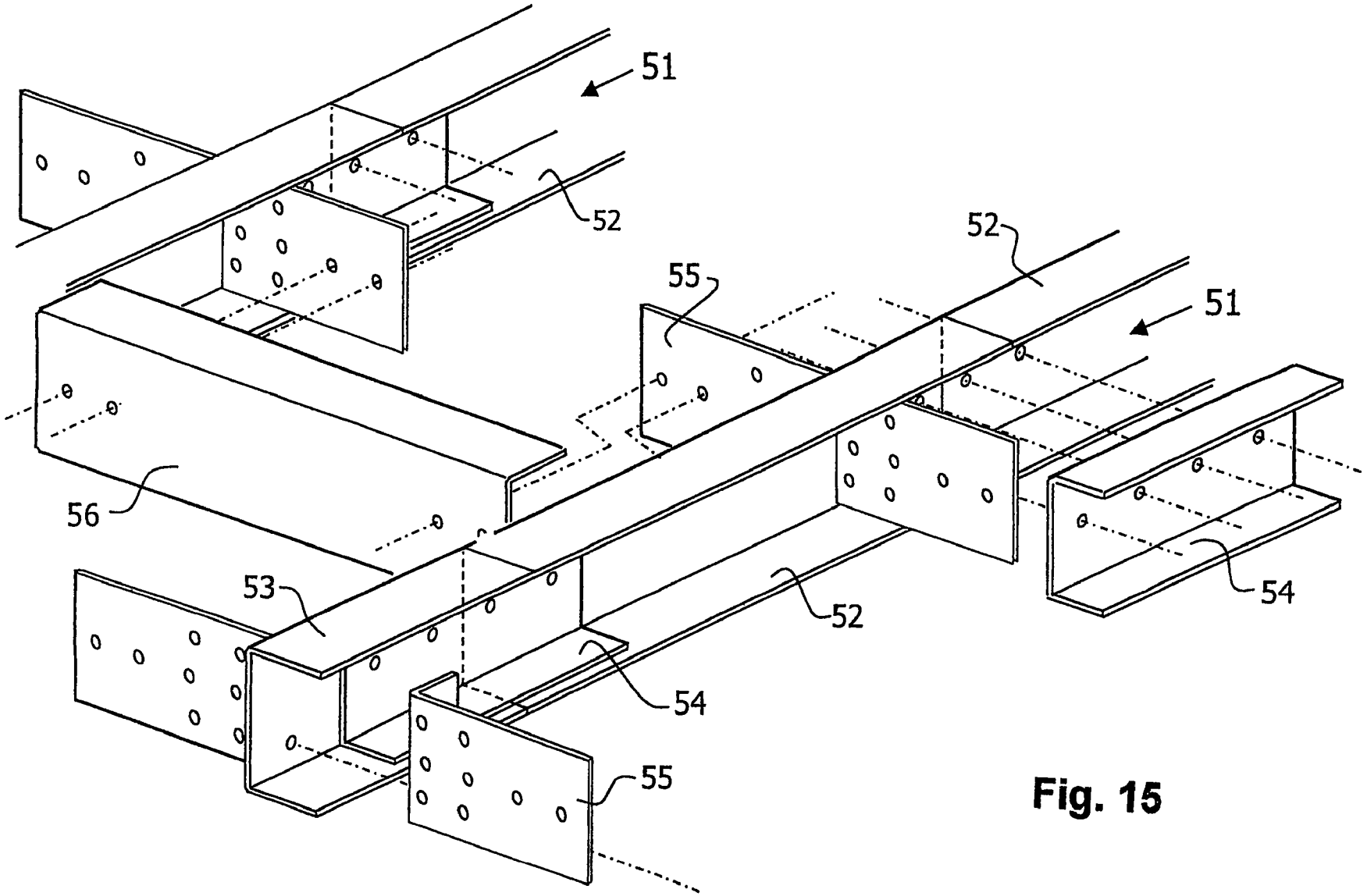
FIG. 15 shows, by means of a partially exploded view, the assembly of sleepers and beams that comprise the latticed base structure of the pool.

The floor of the pool comprises a supporting structure upon which the closing panels or "tiles" are placed. As depicted in FIG. 15, said base structure consists of a rectangular lattice comprising a plurality of parallel metallic U-shaped beams 51 having metallic U-shaped sleepers 56 placed crosswise between them. In a preferred embodiment, said beams and said sleepers may have the same height. As shown, beams 51 are composed of several modular elements 52 (in the central part of the beams) and 53 (at the ends of the beams) butt-joined with side-plates 54. Sleepers 56 are attached to said beams by means of L-shaped plates 55. Standardized bolts and nuts (not shown) of the same type of the ones used for side wall assembly are used throughout.

Figure 16:
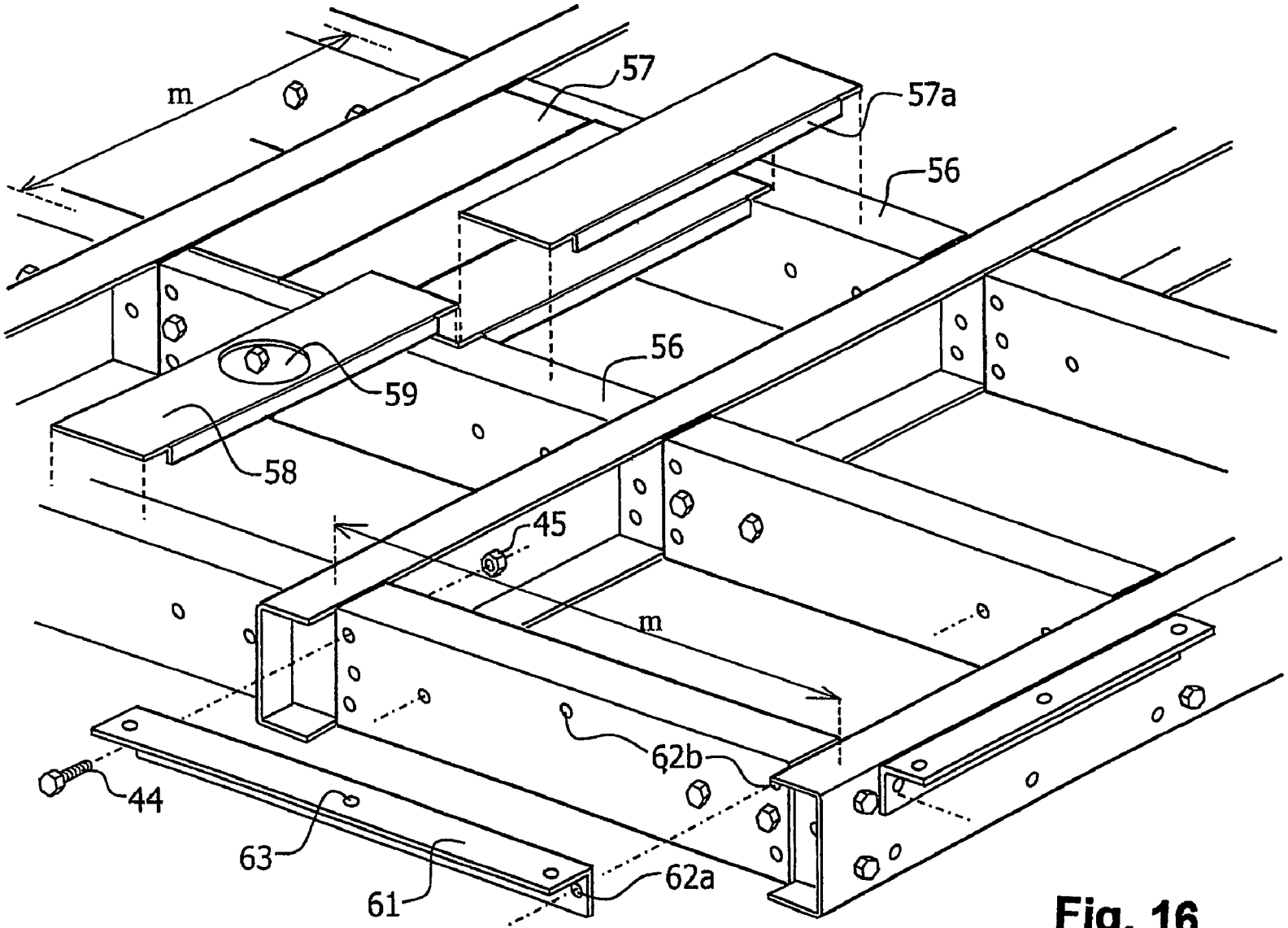
FIG. 16 shows, by means of a perspective view, part of the assembled base structure of the pool and the positions of the angle irons, as well as the panels that form the bottom of the pool.

FIG. 16 depicts part of the assembled pool's base structure, forming a rectangular lattice or grid with module m. This grid supports the pool's floor tiles 57, 58, whose ends rest upon the upper flanges of sleepers 56. As shown in the drawing, said tiles are not bolted to their supporting members, and comprise flanges 57*a* along the greater part of their long sides, said flanges providing the necessary rigidity to resist the vertical thrust due to the water pressure upon the bottom. In addition to the regular tiles 57, special tiles are provided for various specific functions, such as tile 58 that has a central opening 59 to receive the bottom's draining valve assembly.

Figure 17:
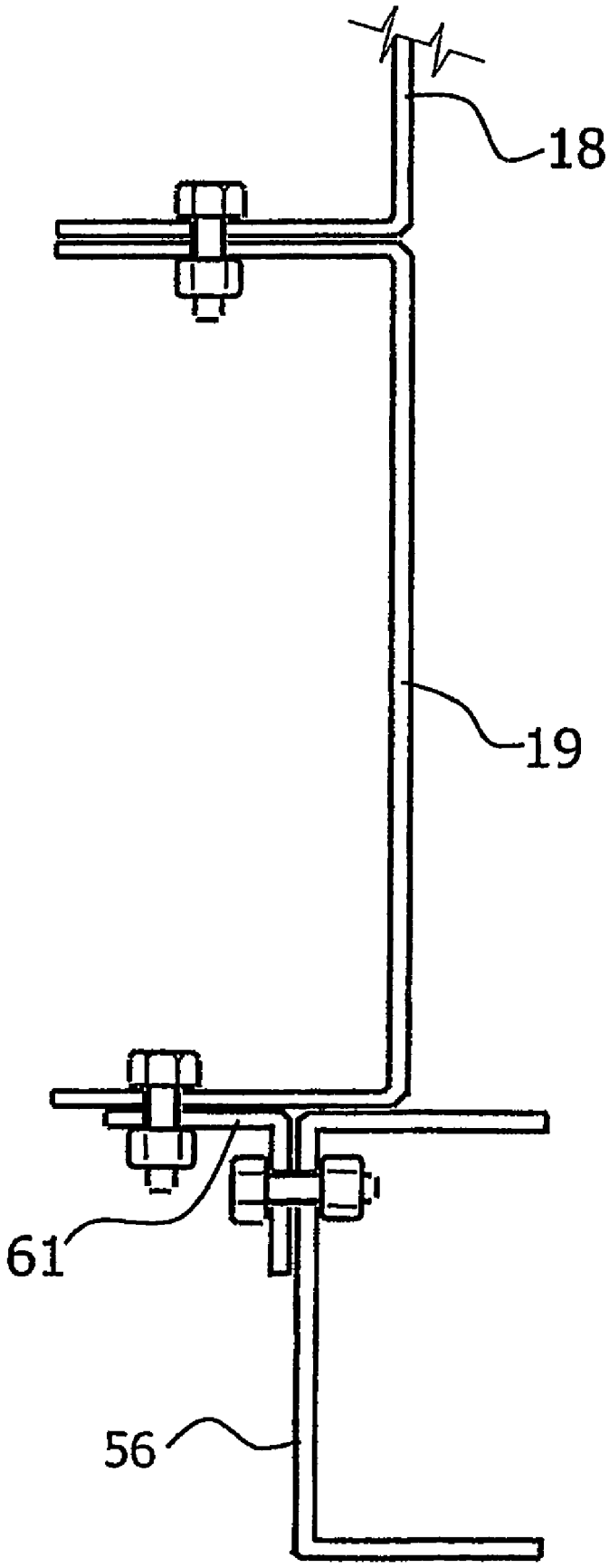
FIG. 17 shows by means of a cross-section view, the joint formed by the side panels of the pool, an angle iron and a sleeper.

FIG. 16 also shows the angle irons 61 that comprise the semi-permanent attaching means between the side walls and the base structure. Said angle irons have through-holes 62*a* on their vertical flanges, placed in coincident positions with holes 62*b* on the sleepers as well as on the beams, to which they are attached by means of bolts 44 and nuts 45. The horizontal flanges of said angle irons are provided with through holes 63, which are coincident with holes 36 on the lower flange of the wall panels. According to the cross-section view of FIG. 17, the bottom flanges of the panels of the lower tier 19 of the side walls are bolted to the horizontal flanges of said angle irons 61, which have their vertical flanges bolted to the perimeter beams such as sleepers 56 of the base structure, allowing the horizontal stresses upon said side walls to be unloaded on the base structure.

Although the preceding description refers to swimming pools, the invention has a wider range of applications such as iced water reservoirs for air conditioning systems retrofitted into existing buildings. In this case, the reservoir can be placed over existing floors, such as in garages or courtyards, thermal insulation being provided by polyurethane or polystyrene sheets inserted between the walls and bottom and the inner vinyl lining of the reservoir.

Therefore, the object above described may be modified within the conceptual limits of the invention, being only limited by the following set of claims.

The invention claimed is:

1. A modular pool comprising substantially vertical side walls comprising modular metallic panels and a floor comprising metallic tiles, said side walls and said floor resting upon a base structure formed from a lattice comprising metallic U-shaped beams with metallic U-shaped sleepers placed crosswise between said beams, each one of said modular metallic panels comprising a central vertical rectangular portion with flanges along its horizontal and vertical edges, the horizontal flanges along the horizontal edges being at right angles to said central portion, and the vertical flanges along at least one of the vertical edges being at right angles to said central portion, said central vertical rectangular portion being flat, each wall comprising one or more assemblies formed by the superposition of two or more said modular metallic panels assembled in a vertically coincident relationship with their vertical sides rectilinearly aligned, the juxtaposed horizontal flanges of said superposed modular metallic panels being joined by semi-permanent attaching means and the vertical flanges of each assembly being vertically aligned in a rectilinear relation, and a vertical reinforcing member which has its length substantially equal to the height of said assemblies being interposed between the vertical flanges of adjacent assemblies and attached thereto by semi-permanent attaching means, in which the floor of said pool comprises a plurality of metallic modular tiles forming a substantially planar surface which supports the vertical pressure due to the water inside the pool, wherein each said modular tile comprises:

a rectangular flat plate having:

longer sides and shorter sides:

ends that rest upon the sleepers of said base structure:

and marginal portions between said sleepers, said marginal portions being bent downward forming flanges along the longer sides of said flat plate, said tiles being placed with said flanges in a mutually adjoining relation.

2. The modular pool of claim 1, wherein said vertical reinforcing member is an elongated plate.

3. The modular pool of claim 1, wherein the vertical flanges of the assemblies are provided with through-holes and said vertical reinforcing member is an angle iron provided with through-holes in positions coincident with the through-holes of the vertical flanges of the assemblies forming a corner of the pool.

4. The modular pool of claim 1, wherein the upper modular panels of said assemblies are provided with upper flanges having through-holes and a lengthwise reinforcement is provided at the top of the pool's walls by a metal plate having through-holes, wherein said through-holes in the metal plate are coincident with the through-holes of the upper flanges of the upper modular panels of said assemblies.

5. The modular pool of claim 1, wherein at least one of said metallic tiles is provided with an opening for a drain in the floor of the pool.

* * * * *